US006502596B1

(12) United States Patent
Danaher

(10) Patent No.: US 6,502,596 B1
(45) Date of Patent: Jan. 7, 2003

(54) PORTABLE FABRIC STRUCTURE

(76) Inventor: Thomas C. Danaher, Apt. 206, 425 N. Maple, Beverly Hills, CA (US) 90210

( * ) Notice: Subject to any disclaimer, the term of this patent is extended or adjusted under 35 U.S.C. 154(b) by 13 days.

(21) Appl. No.: 09/894,658

(22) Filed: Jun. 28, 2001

(51) Int. Cl.[7] ..... E04H 15/40

(52) U.S. Cl. ..... 135/126; 135/128; 135/143; 160/135; 160/370.21; 160/DIG. 2; 446/478; 446/488

(58) Field of Search ..... 135/121, 124, 135/125, 126, 128, 143, 130, 127; 160/135, 370.21, DIG. 2; 446/488, 478, 487, 476

(56) References Cited

U.S. PATENT DOCUMENTS

| | | | | |
|---|---|---|---|---|
| 3,288,157 | A | * | 11/1966 | Szkolny |
| 3,665,944 | A | | 5/1972 | Knapp |
| 3,848,615 | A | | 11/1974 | Warner et al. |
| 3,929,145 | A | | 12/1975 | Schroeder |
| 3,960,161 | A | | 6/1976 | Norman |
| 3,970,096 | A | | 7/1976 | Nicolai |
| 3,990,463 | A | | 11/1976 | Norman |
| 4,569,362 | A | | 2/1986 | Fidler, Jr. |
| 4,682,436 | A | | 7/1987 | Ritson |
| 4,815,784 | A | | 3/1989 | Zheng |
| 4,825,578 | A | | 5/1989 | Robinson |
| 4,825,892 | A | | 5/1989 | Norman |
| 4,846,205 | A | | 7/1989 | Knoll |
| 4,979,531 | A | | 12/1990 | Toor et al. |
| 5,029,847 | A | | 7/1991 | Ross |
| 5,031,652 | A | | 7/1991 | Lester |
| 5,137,044 | A | | 8/1992 | Brady |
| 5,343,887 | A | | 9/1994 | Danaher |
| 5,452,934 | A | * | 9/1995 | Zheng ..... 296/97.7 |
| 5,628,357 | A | * | 5/1997 | Hwang ..... 160/370.21 |
| 5,632,318 | A | * | 5/1997 | Wang ..... 160/370.21 |
| 5,722,446 | A | * | 3/1998 | Zheng ..... 135/125 |
| 5,845,697 | A | * | 12/1998 | Zheng ..... 160/370.21 |
| 5,975,101 | A | * | 11/1999 | Zheng ..... 135/125 |
| 6,092,544 | A | * | 7/2000 | Zheng ..... 135/125 |
| 6,289,910 | B1 | * | 9/2001 | Zheng ..... 135/125 |
| 6,318,394 | B1 | * | 11/2001 | Zheng ..... 135/126 |

FOREIGN PATENT DOCUMENTS

| | | |
|---|---|---|
| AU | 49503/72 | 6/1974 |

OTHER PUBLICATIONS

CAMPMOR—Mid–Summer 1989, pp. 7, 8 & 9 Pop–Tent, Inc. (Advertisement).

* cited by examiner

*Primary Examiner*—Yvonne M. Horton
(74) *Attorney, Agent, or Firm*—Reising, Ethington, Barnes, Kisselle, Learman & McCulloch, P.C.

(57) ABSTRACT

An elongated portable structure for use as a tent or the like, having at least one end panel. The end panel has a sheet of substantially non-stretchable flexible fabric material disposed in a generally upright orientation. Two hoops of flexible, resilient, strip material are attached to the sheet. The sheet has portions in the spaces within the hoops to maintain the hoops taut and to resist collapse or distortion of the hoops. A flexible fabric cover extends from the end panel to provide shelter for a person occupying the structure. The hoops are capable of being twisted into a flat coil of reduced diameter for storage. The structure may have a second end panel with hoops, similar to the first end panel.

25 Claims, 4 Drawing Sheets

PORTABLE FABRIC STRUCTURE

This invention relates generally to freestanding structures such as tents and the like.

BACKGROUND AND SUMMARY OF THE INVENTION

For thousands of years, large-scale tensioned fabric structures have been used as shelter and protection for groups of people. Large-scale structures pre-date the smaller versions, typically used by two or three people, which were designed only in the last few centuries. Innovations and improvements have modernized virtually every aspect of the smaller versions and currently the field of invention for these structures is very crowded and a minor advance carries great weight. Despite the overcrowding of patentable art in the field of small structures, most of these improvements have not been practiced on larger-scale structures, leaving these designs crude in comparison. It has been more than 30 years since large-scale design having today's widest commercial and industrial acceptance was developed.

All present-use tensioned fabric structures utilize some sort of weight-bearing pole framework which forms a skeleton upon which the fabric cover is suspended. As such, the pole framework performs the function of supporting the fabric weight and the fabric cover performs the separate function of establishing the structure's sheltering walls and roof. In prior-art structures, the two functions work against each other to create the tension referred to in the generic Class of this invention, "Tensioned fabric structures". In the author's opinion, all prior-art design wrongly separates these two functions into opposing roles. By not integrating the support and covering functions in a cooperative, co-active role, present-use structures suffer from a number of disadvantages. My prior U.S. Pat. No. 5,343,887 describes the disadvantages suffered in the field of small-scale structures; this present invention addresses the various types of problems suffered by large-scale structures.

One of the principal problems with large-scale structures is that associated with erecting them. The assembly process is complicated and exacting, rendering set-up by one person impossible and often three or more persons are required. The process involves unpacking a bewildering assortment of pole segments, stakes, guy-lines and an enormous flaccid fabric cover which is many times bigger than, and has no apparent relationship to, the structure's final set-up shape. The most rudimentary embodiments require a minimum of six vertical rods (each of which is typically longer than five feet), at least three horizontal support poles (each usually has a length of more than seven feet), and several (the simplest structure requires eight) stakes and/or guy-lines. The set-up and trimming process guarantees that the assembly procedure of all prior-art large-scale structures is never the same twice, each is a laborious and custom installation. If the users suffer from lack of experience or a momentary negligence, they may upset the delicate balance of the partially-erected structure at any time during the set-up procedure, causing them to start again and all their progress lost. Furthermore, if any one of the components is lost, torn, broken or misplaced, set-up of these prior-art structures could be impossible.

Present-use large-scale design requires users to anchor the fabric cover to the terrain with stakes, guy-lines or the like. This is a second handicap as such structures are incapable of being relocated after they are assembled. The tensioned support is violated when any stake, rod or other anchoring mechanism is moved; relocating involves dismantling the frame and extensive anchoring means and rebuilding from the beginning. Structures lacking freestanding capability are also unsuitable for scree, rocky or sandy terrain.

The weight of prior-art large-scale structures is a third liability which smaller-structure design has attacked zealously. It is not uncommon for a smaller structure accommodating two users to weigh as little as three or four pounds while larger structures accommodating six users can weigh more than sixty pounds. The inefficient distribution of stresses in large-scale prior-art design, caused by separating the support function from the covering function as described previously, feeds a vicious circle of ever-increasing weight: heavier framing members require heavier fabrics which in turn require enhanced frame support, calling for still heavier fabrics, etc., etc., etc. Further, present-use designs strengthen stress areas assiduously with weighty reinforcement means. Additional support poles, rods, stakes and/or guy-lines to relieve the fabric of poorly diffused stress add further weight, complexity and expense.

The high cost of present-use structures is a fourth significant detriment. Because the supporting and covering functions are set in opposition, stresses inherent in large-scale design require framing members and fabrics not only heavier but also much more costly than necessary. Poles and rods are generally expensive components and heavier versions are even more costly to produce, ship and warehouse. Workmanship to cut and handle brawnier fabrics is more complicated and sewing is much more difficult. Reinforcing large areas as described increases manufacturing complexity and expense. Workmanship to attach myriad stakes, guy-lines and another anchoring means increases manufacturing costs while purchasing additional parts requires expensive outsourcing.

All prior-art large-scale fabric structures suffer a fifth and final drawback regarding their limited range of sizes and/or shapes. Present-use large structures are square or slightly rectangular; to erect larger structures or to utilize shapes other than these limited options introduces an entirely new level of complexity which is evidenced at outdoor events and the like where typically rented facilities accommodating larger groups of people involve an experienced full-time staff of many members and usually a full day for set-up or disassembly.

It is unfortunate that the designs of smaller-scale support structures, including their innumerable variants, can not be adapted for large-scale embodiments. Smaller-scale structures utilize bowed poles to place the fabric cover under tension; users skilled in the art recognize the difficulty and possible danger of bending enlarged support poles if adapted for use with larger-scale structures which typically use rigid and inflexible frame members. Also, smaller designs, if adapted, would lack basic functional capability: the simplest embodiments utilizing two or three support poles are undependable in ordinary winds without profuse anchoring, larger versions of these designs would be totally implausible. Designs of more elaborate smaller-scale embodiments utilize semispherical pole formations which employ arc trigonometry formulae that cannot be adapted if a low profile structure is required. These disadvantages, developed further in the following sections, effectively eliminate the possibility to adapt the myriad designs of small-scale embodiments for use as large-scale structures and today no such versions are recognized commercially.

Large-scale, freestanding tension structures which do not employ the inefficient support structure described previously have been disclosed in the prior art. My U.S. Pat. No. 5,343,887 describes a stable, lightweight, easy to assemble, portable fabric structure which eliminates weight-bearing support poles and rods by utilizing an end panel at each end, comprised of resilient strip material formed into a single hoop secured to flexible fabric covering and maintained in generally upright position by at least one spreader rod extending between the end panels. The end panels preferably have circular hoops, yet circles, by definition, are as tall as they are wide so by enlarging such structures the height and width are coequally increased. Thus the invention of my U.S. Pat. No. 5,343,887 is intended primarily or small-scale structures rather than for large-scale embodiments where height becomes a limiting factor.

A circular framing member can be made oval as described in my U.S. Pat. No. 5,343,887 by increasing tension along its horizontal axis. Utilizing an oval frame member provides for a shorter and wider structure than an embodiment utilizing a circular framing member. However, after exceeding a limited and invariable horizontal-to-vertical ratio, an oval framing member suffers loss of capability as the fabric-covered oval fails to supply any weight-bearing role without distortion or collapse. This ratio is approximately two-to-three (height-to-width) or to put this in other words: if one wants a structure utilizing prior U.S. Pat. No. 5,343,887 one will have a structure two-thirds as tall. While contributing an incremental enhancement vis-à-vis the author's circular embodiment, the limited capability of oval framing members nevertheless limits the possible size of any functionally operable structure described in my U.S. Pat. No. 5,343,887 especially if structures with substantially low profiles are required.

My U.S. Pat. No. 5,343,887 discloses a structure with two fabric end panels, each provided with a single hoop sewn or in any manner attached to the fabric. The hoops are twisted and collapsed when the tent is prepared for storage, and this can be done easily if the tent is not too large. For larger embodiments utilizing larger hoops, the hoops must be twisted several times to reduce the overall size for storage, and this can be quite difficult considering the weight and bulk of the fabric.

In accordance with my present invention, the end panel(s) is provided with two or more hoops rather than just one. Plural hoops relatively small in diameter can be even more effective than one large hoop and are much easier to handle when twisted for storage, especially for large-scale structures.

Several advantages of the present invention are:

1. Novel Support Element:

My invention uniquely integrates the support and cover functions by means of novel fabric-covered hoops which act as the weight-bearing support element while simultaneously forming the structure's covering end panels. Unlike poles which can bear weight by themselves, the hoops have a tendency to sag into an oval under the slightest load. However, the hoop incorporates a taut non-stretch fabric attached generally at all points to its perimeter, constricting it and thereby preventing sagging. This integrated fabric-covered hoop maintains its original shape despite bearing considerable weight and is a key advancement in the art of fabric-tensioned structures.

2. Easier and Speedier Assembly:

My invention eliminates all of the principal complications in the assembly of prior-art large-scale design:

The user shakes the collapsed structure of my invention and the resilient hoops virtually "self erect." Because these hoops constitute essential parts of opposite end walls, it is uniquely easy to recognize the final shape of the structure during the assembly process.

The fabric-covered hoops of my invention, forming the end walls as described, stand erect by themselves and thus make irrelevant the need to lift end wall fabric during assembly. The self-standing hoops also support the weight of the structure's roof, therefore the complex process of lifting and setting up prior-art structures is greatly simplified.

In short, the design of my invention allows for a large scale structure to be assembled in the shortest possible time and with the fewest people. The structure can be set up by novice users. The tedious "learning curve" associated with other structures is eliminated. As well as easily introducing new users to the sport of outdoor camping, the simplicity of assembly also enables the structure of my invention to be used as shelter for groups in emergencies. Ease of assembly is crucial in inclement or severe environments or where users are setting up the structure for the first time.

3. Structurally Capable in any Size:

The end panels of my invention can be adapted in a wide variety of configurations to provide for structures of any size. By utilizing more than a single hoop at the structure's end panel, the tent can be enlarged without increasing its height. Two adjacent hoops, for example, double the structure's width, three hoops triple it, etc.

The end panels can be still further adapted in a wide variety of configurations to provide specific advantages without compromising the objects of the invention. The preferred embodiment establishes multiple hoops in a generally adjacent and approximately flat end panel in-use configuration. Multiple hoops can also be configured to form a wedge or similarly shaped non-flat end panel to provide for increased internal space and/or windworthiness. The end panel can also be further adapted to provide for even larger structures: additional fabric can be provided in the space(s) between the multiple hoops to enlarge the width of the tent without increasing the height; hoops positioned above one another allow for taller structures if required. Moreover, the end panel or at least one of the multiple hoops therein can be inclined and/or the acclivity of one or both sidewalls increased to maximize floor space. These adaptations do not alter any of the tent's structural components nor compromise any of the invention's capabilities.

4. Freestanding:

The tent of my invention in some embodiments requires no stakes or guy-lines running to outlying stakes to establish structural support. These anchors typically suffer the obvious disadvantage of coming loose either by the tent working the wind or by the user tripping over them during darkness. My invention is suitable for rocky or sandy terrain or impenetrable hardpan, also the orientation can be rapidly changed under varying weather conditions if necessary.

5. Stronger:

As is well known to those skilled in the art, circles, ellipses and arches disburse weight evenly and with great stability. The end panels of my invention easily distribute the considerable weight of the covering fabric of a large-scale structure. Stresses common to prior-art tents are distributed naturally throughout the hoop(s) so stress points and compensating reinforcement are minimized.

A user can lean on the walls of my invention and the hoops will move to absorb stress from any direction. It is practically impossible to break the integrated fabric-cover hoop so the chances of collapse or permanent damage to the tent are minimized.

Further, the circular design of my invention deflects loads caused by rain, wind, ice rime and/or snow. As disclosed previously, the invention can be altered for increased wind worthiness without changing the tent's structural components. By inclining one or both end-walls of the structure and/or increasing the acclivity of the sidewalls, the target size of the structure is reduced for extra dependability in deflecting heavy wind loads and to facilitate shedding of snow and wind-driven rain in inclement weather.

6. More Internal Space with Less Material:

Nature's most efficient shape (maximum internal volume with minimum surface area) is a sphere. Due to the novel circular-based hoop design of the end panels, my invention encloses more cubic living space per given amount of fabric than any prior-art tension structure. Putting this another way, to provide a structure of given internal size, an advantage of my invention is that it requires less fabric.

7. Lighter:

Fabric-covered hoops distribute stress evenly throughout the hoop's perimeter so lighter fabrics can be adopted and reinforcing minimized. Also, as previously described, a structure of any particular size can be made with a minimum of fabric thus reducing a principal factor contributing to a structure's weight.

8. Full Use of height, Increased Headroom and Floor Use:

Prior-art designs allow the user to stand erect in only a small central or apex portion of the structure. The consistent, uniform height of my invention eliminates any such apex and provides for uncompromising utilization of the structure's full height throughout the entire length of the structure.

My invention's circular design further provides increased headroom as its shape correlates to the space used by a users' upper body movements.

Many, but not all embodiments of my invention provide rectangular or square floors correlating to the shape of the users' sleeping bags and related equipment. Sleeping bags and user gear may be pushed all the way to the edge of the structure if desired because the vertical sidewalls allow for optimum use of the floor area.

9. Fewer Components:

Because the fabric-covered hoop is both the support element and also the structure's end walls, my tent requires far fewer support members compared to prior-art tents. Fewer parts can be broken or misplaced; complexity during set-up, teardown and in-use is reduced; maintenance is minimized. In some embodiments, rods and poles are completely eliminated; in other embodiments, only a single rod is utilized. In still further embodiments, no sleeves, stakes, tie members, flaps, straps, grommets, buckles or guy-lines are needed.

10. Ease of Production:

The consistent height of my invention reduces the number of separate fabric pieces and minimizes workmanship in cutting and sewing of irregular fabric patterns. Additionally, full widths of material can be utilized eliminating fabric waste. Costly reinforcements to counteract fabric stresses are substantially reduced as are the needs for support means and anchoring means as mentioned above.

11. Less Expensive:

Due to the superior strength and efficiency of the hoop design, the capability to utilize lighter, less expensive fabrics and to minimize fabric waste in production, ease of cutting and sewing, the reduced need for support members, etc., as described, the tent of my invention is less expensive to produce than all other large-scale prior-art fabric tension structures. Containerizing, shipping and insurance costs are correspondingly reduced.

12. Superior Compatibility:

The structure of my invention folds into a packed relatively flat disc by taking three turns in the manner described in prior U.S. Pat. No. 5,343,887. Instead of folding a very large single hoop, however, multiple smaller hoops are turned as a "hoop group" into a readily portable flat circular configuration. Prior patent 5,343,887 describes tents which fold to one-third or one-ninth of the loop's size when opened; the patent of my present invention can double or triple this factor and, in some embodiments, the structure folds to less than one-fiftieth the size of the end panel when opened.

One embodiment features an end panel which is releasibly attached to the covering fabric by means such as zippers or the like. When the end-panels are separated from the covering fabric, bulkiness during folding is reduced and nine hoops can be taken to provide for a smaller collapsed parcel. Weight of the packed disc is evenly distributed and balanced for ease of transport. In another embodiment, folding is facilitated by removing the hoops from the fabric sleeves of the end panel. The loops can be reinserted or end-panels reattached and the structure regains full structural capability and efficacy. Separating the hoop(s) from the fabric utilizing the two means as described above, either severally or in combination, allows for optimized folding and packing.

It is therefore, an object of the present invention to provide an improved fully freestanding, portable large-scale structure.

A second objective of this invention is to provide such a structure which can be erected readily by fewer users.

Another object of the invention is to provide a versatile large-scale structure which can be truly made in a plurality of sizes depending on design parameters.

Still another object of the invention is to provide a large-scale structure which can readily be folded into a compact size for storage and transportation purposes.

It is further an object of this invention to provide such a structure which is extremely simple and economical to manufacture.

It is a further object of this invention to provide a fully-accessible floor, increased headroom and greater cubic living space while using less fabric than prior structures.

It is still a further object to provide a large-scale structure light in weight.

A further object is the provision of a novel, inherently integrated design wherein fabric-covered loops support the structure's weight and form its walls.

A still further object is to provide a rugged, essentially non-breakable large-scale structure.

A further object is to provide a stable, windworthy large-scale structure.

A still further object is the provision whereby a hoop, fabric therefore and cover cooperate to define a unitary assembly of unique design and decorative appearance.

The above and other objects are realized by the provision of a self-contained freestanding large-scale tension structure which in general terms comprises one or more end panels, at least one of which comprises two or more approximately adjacent hoops of flexible coilable resilient material and a flexible fabric cover extending between said panels. The end-panels, or hoops of flexible material therein, are held in a generally upright position preferably by a single segmented rod which exerts tension horizontally and in opposite directions.

The hoop is affixed. to a flexible fabric-like taut sheet material; more particularly, by securement at least at a plurality of points between the fabric and the hoop. Hoops are preferably endless and closed, but as described earlier in this patent, ends of the coilable strip material may be releasably connected to provide for removal of the loop from the fabric-like taut sheet material for ease of packing and storage.

The hoops can take on any of a wide variety of specific configurations. For example, the hoop can be compelled into an oval shape by increasing tension in its covering fabric in either the vertical or horizontal direction. Alternatively, the hoop can be fabricated into a circle, ellipse or arch shape. A hoop having one or more generally right-angle square corners in an otherwise circular or elliptical shape is possible. The loop may incorporate extension(s) running to the ground or to other parts of the end panel. Each embodiment offers separate advantages without compromising the objects of the invention.

The end panel flexible fabric cover can incorporate one loop style or shape or a combination of different styles without affecting the capability or operability of the structure. The integrated fabric-covered hoop maintains its weight-bearing capability when the hoop's covering fabric incorporates openings or voids to provide access to the outside of the structure. One end panel may utilize two adjacent hoops and the other end more than two hoops and the structure collapses fully and suffers no loss of capability. The other end may also utilize fewer hoops or even none, for example when attaching the fabric cover to a separate structure to provide for a spare room. This adaptation provides for ultra-lightweight structures similar to tents known in the prior art as a "bivvy". It should be understood that connections between adjacent hoops are preferable in some embodiments, but are not essential. Also, the two hoops of an end panel can be of different sizes if required.

The frame, as described, is held in the desired in-use configuration by a flexible fabric cover extending between the end panels. The fabric cover can take on a wide variety of specific configurations without compromising the invention. For example, in some embodiments, additional floor space can be provided by increasing the acclivity of the covering fabric side-walls. In other embodiments, the fabric floor can be eliminated. The structure can be adapted with openable and extendable side-wall(s) to provide for a cabana-like structure with shade-giving awning(s). The fabric can be further adapted to provide space between it and a separate or integrated rain fly. The end-panel can be releasably attached to the fabric cover, by means of a zipper or the like, to allow for the two components to be separated and folded independently for ultimate compactibility.

Because of the coilable nature of the hoop material and the flexibility of the fabric covering, the structure can be "collapsed" in an orderly fashion by manipulating the loops in a simple manner as described in my prior U.S. Pat. No. 5,343,887. Upon collapse, the structure assumes a flat circular configuration which is readily portable and which virtually self-erects upon further manipulation.

Each of the above components, as disclosed in the preferred embodiment described in further detail below, can be altered without compromising the efficacy of the invention. For example, the framing means of the several embodiments are interchangeable. The diverse configurations of the fabric cover are practicable on any embodiment. Likewise, all of the end panel loop configurations of the several embodiments herein disclosed are interchangeable with one another.

The features, advantages, and objects of my invention which are explicit and implicit in the foregoing as well as others will become apparent and more fully understood from the following detailed description of the invention in connection with the accompanying drawings.

DETAILED DESCRIPTION OF THE PREFERRED EMBODIMENTS

Figure 1:
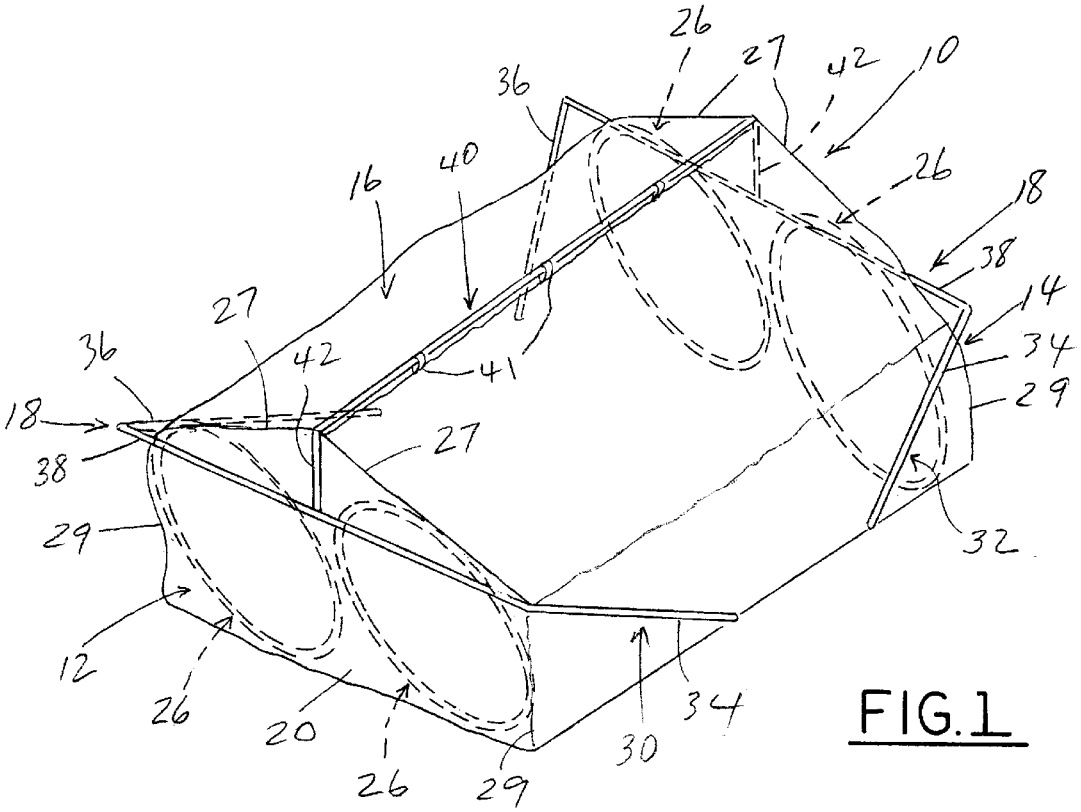
FIG. 1 is a perspective view of a tent constructed in accordance with the invention.
Figure 2:
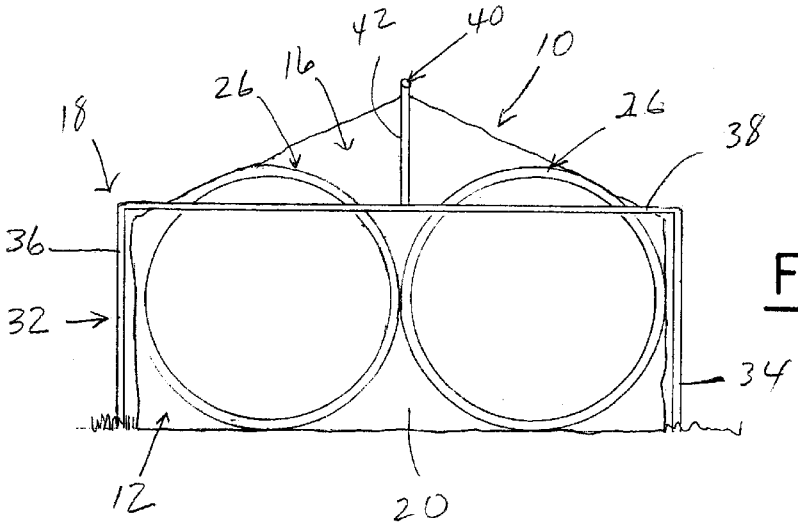
FIG. 2 is an end view of the structure shown in FIG. 1.
Figure 2A:
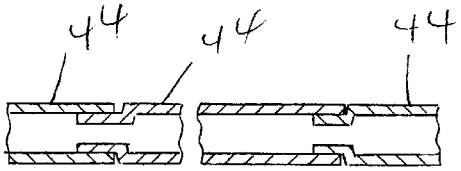
FIG. 2A is a fragmentary sectional view showing a portion of a segmented rod.
Figure 3:
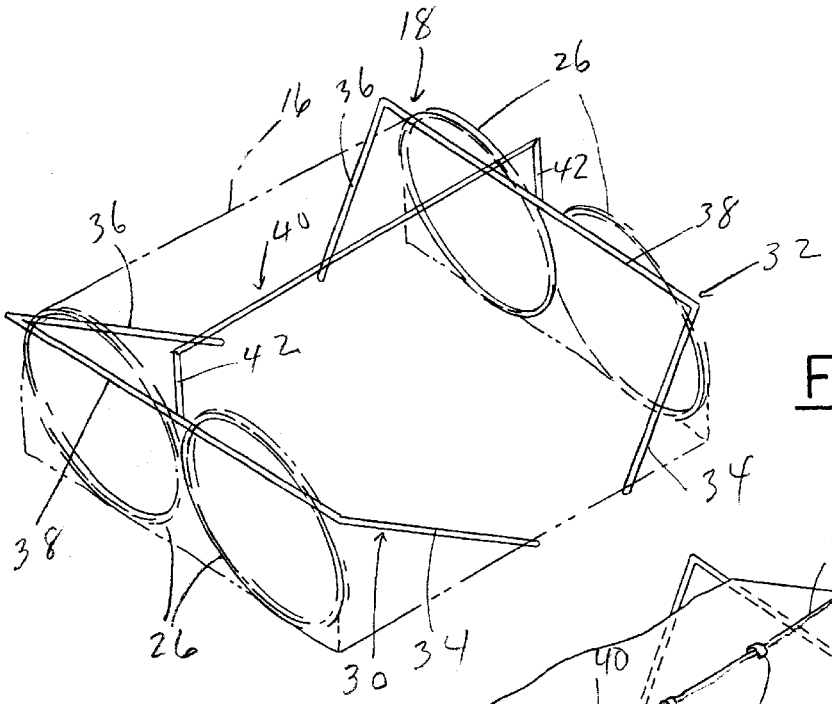
FIG. 3 is a view similar to FIG. 1, but with the fabric removed to better illustrate the skeleton frame.

Referring now more particularly to the drawings, and especially to FIGS. 1–3, the enclosure 10 is an elongated portable structure for sheltering one or more persons, commonly referred to as a tent. The structure or tent 10 comprises end panels 12 and 14, a flexible cover 16, and means for holding the end panels in longitudinally spaced, generally upright position including framing 18.

The end panels are preferably of identical construction, each comprising a sheet of 20 of substantially non-stretchable fabric and a pair of framing members in the form of generally circular hoops 26 of flexible, resilient strip material such as spring steel or plastic, for example. The hoops 26 of each end panel preferably are disposed in the plane of the sheet 20 and secured to the sheet, preferably on the inner side thereof, as by stitching throughout all or at least a portion of the circumference of the hoops. The portion of the sheets within each hoop is held taut by the hoop and resists distortion or collapse of the hoop. While only two hoops 26 for each end panel are shown, it will be understood that for greater width structures, three or more hoops may be provided to make up each end panel. The hoops of each panel may be close together or spaced apart. If close together, they may be releasably connected together as by a cinch, not shown. The hoops of each end panel may also overlap.

By employing two or more hoops in each end panel of a tent structure, it is possible to substantially increase the overall width and/or height of the tent so that in theory at least there is no limit to the size of structures that may be erected according to my invention. By employing two or more hoops to make up each end panel, it is possible to make a very large tent with smaller hoops than would be required if only a single, larger loop were employed.

The cover 16 is substantially non-stretchable flexible fabric and extends between the end panels 12 and 14. The cover 16 is held fairly taut by having its ends stitched or otherwise secured to the margins of the end panels as by a zipper, for example. The ends of the top portion of the cover are secured as by stitching to the top edges of the sheets 20 of the end panels along the lines 27. The ends of the generally vertical sides of the cover are secured as by stitching to the generally vertical side edges of the sheets 20 along the lines 29. The sides of the cover preferably extend to the ground. The cover may have an opening (not shown) for ingress and egress.

The tent may be floorless and erected over bare ground, as shown. It may also be erected over suitable flooring which may consist of a simple pad which could be connected to the cover 16 as by stitching.

The framing 18 includes end frames 30 and 32. Each end frame is generally U-shaped, having rigid side frame members 34 and 36 integrally connected by a rigid cross frame member 38. Each cross frame member 38 is releasably secured by any suitable means to the sheet 20 of each end panel 12, 14. The side frame members 34 and 36 extend from the ends of the cross frame member 38 along the outer sides of the tent and downwardly at an acute angle to their lower ends which are anchored in the ground or to the fabric cover. The cross frame members 38 are preferably on the outer sides of the end panels 12 and 14.

The framing 18 also includes an elongated substantially rigid ridgepole 40 which extends lengthwise of the tent and defines the top of the tent. The ridgepole releasably supports the cover 16 by any suitable means such as clips 41. The ends of the ridgepole 40 are releasably connected to vertical connector frame members 42 which are secured to and extend upwardly from the cross frame members 38. Vertical connector frame member 42 can be eliminated by bending or otherwise adapting ridgepole 40 to releasably connect to frame bar 38 or, by means of clips or the like, to be releasably secured to end panel fabric 20, or hoops(s) 26 or anchored to the ground (not shown).

The end frames 30, 32 and ridgepole 40 are preferably, although not necessarily, formed of a plurality of segments 44 which are releasably telescoped together end-to-end as shown in FIG. 3A. Thus, the length of the frame members of the end frame and the length of the ridgepole may be increased or decreased by adding or subtracting segments. A suitable and more elaborate segmented construction for the framing is shown in my prior U.S. Pat. No. 5,343,887, the disclosure of which is incorporated herein by reference.

Figure 4:
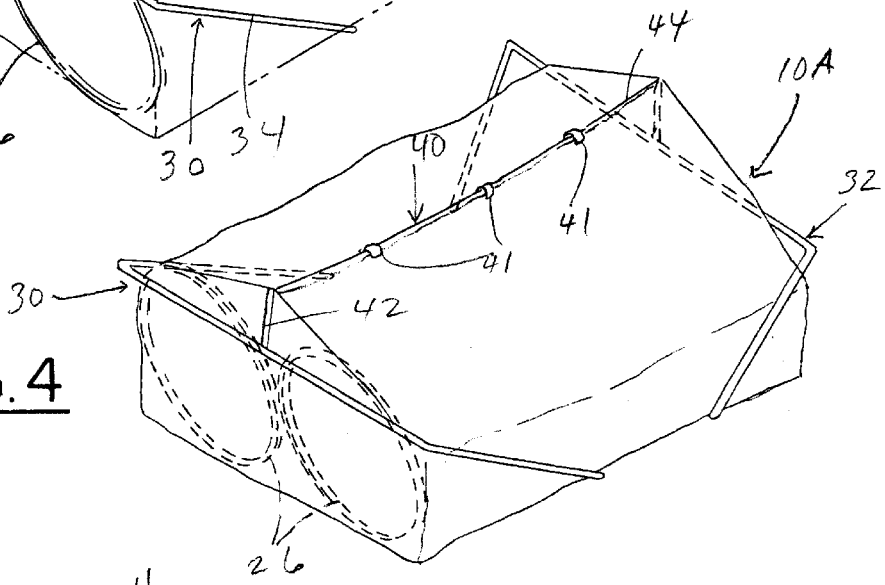
FIG. 4 is a perspective view similar to FIG. 1, but shows a modification in which a ridgepole in FIG. 1 is replaced by a flexible cord.

FIG. 4 shows a modification 10A in which the ridgepole 40 of FIG. 1 is replaced by an elongated flexible cord 44 supporting the cover by clips 41 and connected at its ends to the connector frame members 42. Otherwise the tent 10A in FIG. 4 is the same as the tent 10 in FIGS. 1–3.

Figure 5:
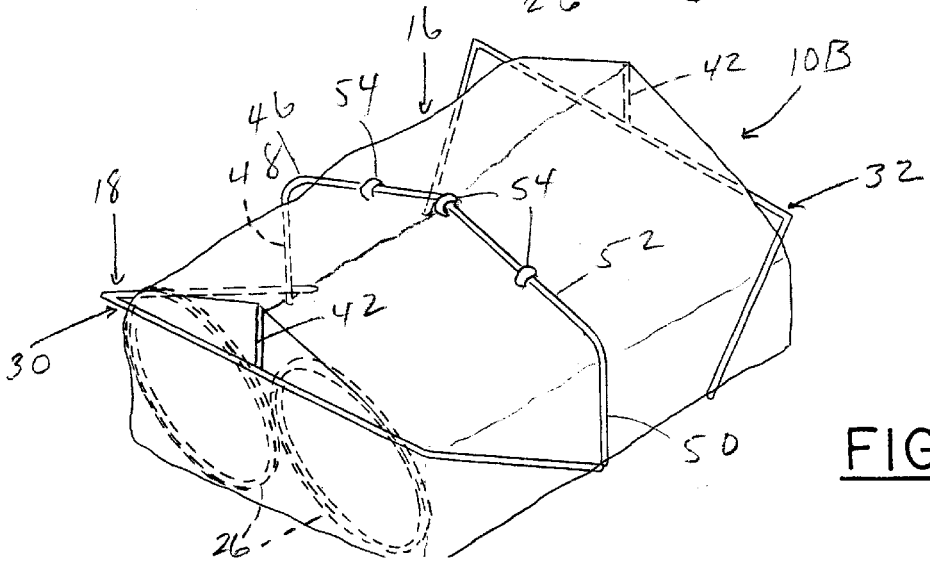
FIG. 5 is a perspective view similar to FIG. 1, but shows a further modification in which the ridgepole is replaced by a center arch.

FIG. 5 shows a modification 10B in which the ridgepole 40 of FIGS. 1–3 is eliminated and an upright center arch 46 is added. The center arch 46 is part of the framing 18 and preferably is of the same segmented construction as the end frames 30 and 32. The center arch is shown on the outside of the tent and over the cover 16 and releasably connected to the cover by clips 41. The center arch is of generally inverted U-shape having rigid side frame members 48 and 50 integrally connected by a rigid, segmented cross frame member 52 the side portions of which incline upwardly to a peak 54 along the longitudinal center line of the tent. The center arch 46 is midway between the end panels of the tent and is in a plane generally parallel to the planes of the end panels. The connector frame members 42 may support the cover 16 along the centerline of the tent. The tops of the connector frame members 42 and the peak 54 of the center arch 46 are at the same elevation to provide a uniform horizontal support for the cover 16. Otherwise the tent 10B in FIG. 5 is like the tent in FIGS. 1–3. Although the center arch 46 is shown outside the cover 16, it could be inside if desired.

Figure 6:
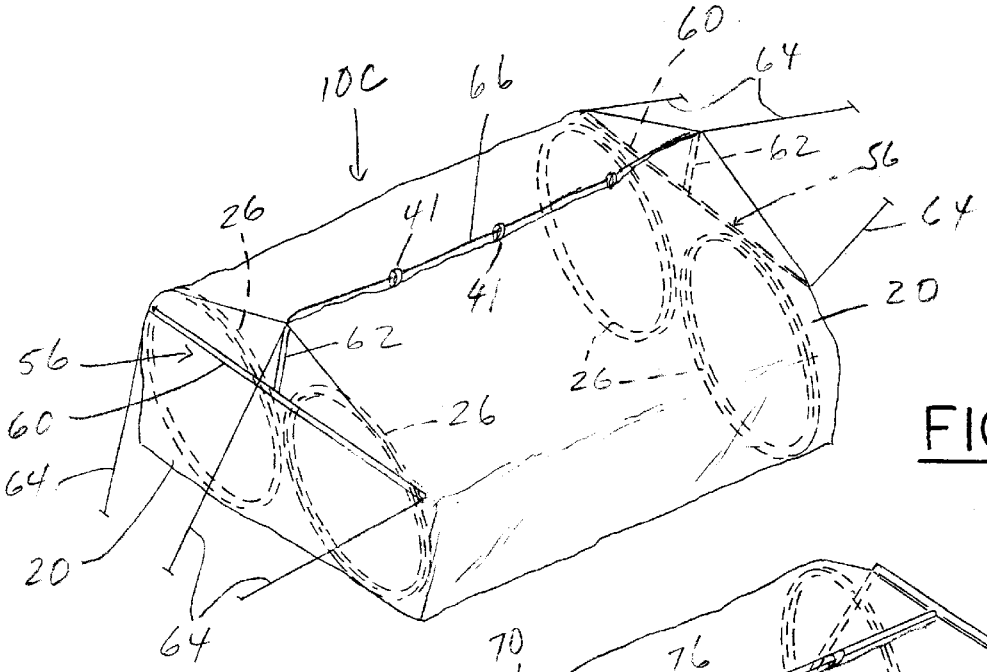
FIG. 6 is a perspective view similar to FIG. 1, but shows another modification.

FIG. 6 shows a further modification 10C. An end frame 56 comprising a rigid, horizontal, segmented cross frame member 60 is releasably secured by any suitable means to the outer side of sheet 20 of each end panel. A rigid connector frame member 62 extends upward from a midpoint in the length of each cross frame member 60. Each cross frame member 56 is supported by flexible guy-lines 64 which extend from the ends of the cross frame member 60 and from the upper end of the connector frame member 62 and are anchored in the ground. Secured to and extending between the upper ends of the connector frame members 62 is a flexible cord 66 which is on the outer side of and is releasably secured to and supports the cover 16 as by clips 41. Otherwise the tent 10C in FIG. 6 is substantially the same as the tent in FIGS. 1–3.

Figure 7:
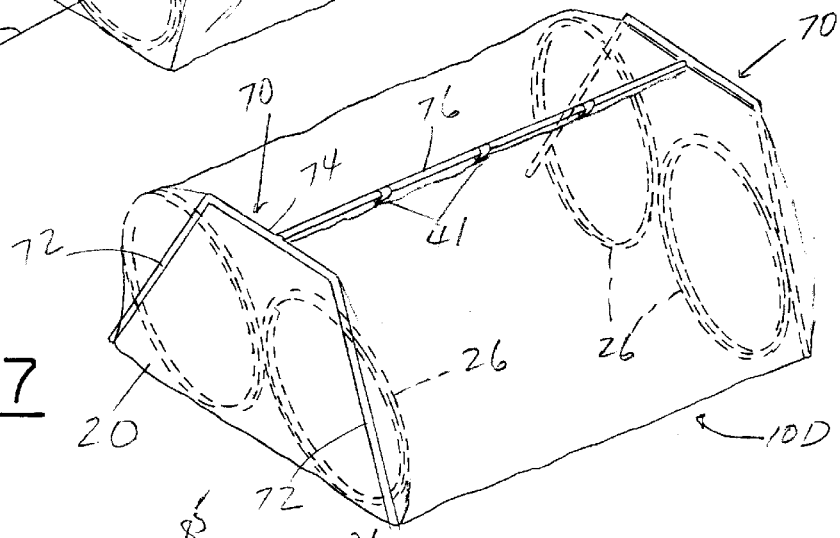
FIG. 7 is a perspective view similar to FIG. 1, but shows still another modification.

FIG. 7 shows a tent 10D in which each end frame 70 comprises laterally spaced, rigid, segmented frame members 72 connected at their upper ends by a rigid, segmented, generally horizontal cross frame member 74. The frame members 72 of each end frame 70 slope downwardly and away from each other along the face of the associated end panel and are secured by any suitable means to the outside of the sheet 20 of the associated end panel. The lower ends of the frame members 72 are anchored in the ground or to the corners of the fabric cover.

A segmented, horizontal, ridgepole 76 extends between and is connected as by clips 41, to the peak of the tent and is terminally connected to the cross frame members 74 of the end frames 70. Otherwise the tent 10D in FIG. 7 is like the tent in FIGS. 1–3.

Figure 8:
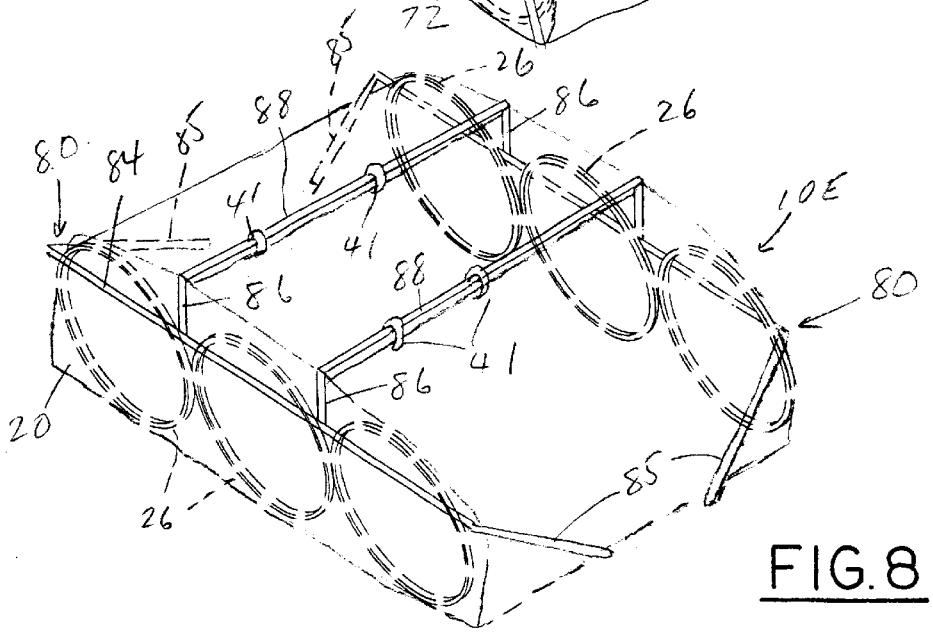
FIGS. 8 and 9 are perspective view showing further modifications.

FIG. 8 shows a tent 10E like the tent 10D in FIG. 7 except that each end panel has three hoops 26 secured to the sheet 20 generally in horizontal alignment, instead of two. End frames 80 are secured to the sheets 20 of the respective end panels and are like the end frames 70 in FIGS. 3 and 4 except that the segmented cross frame members 84 thereof are longer because the end panels of the tent are wider. The lower ends of the spaced, segmented frame members 85 of the end frames extend along the outer sides of the tent at an acute angle and are anchored in the ground or to the fabric cover. Spaced apart connector frame members 86 extend upwardly from the cross frame member 84 of each end frame 80. Spaced, parallel, segmented, ridgepoles 88 extend between and are terminally, releasably connected to the upper ends of selected connector frame members 86. The ridgepoles 88 are releasable connected as by clips 41 to the peak of the cover and could be replaced by flexible cords, if desired. They may also criss-cross.

Figure 9:
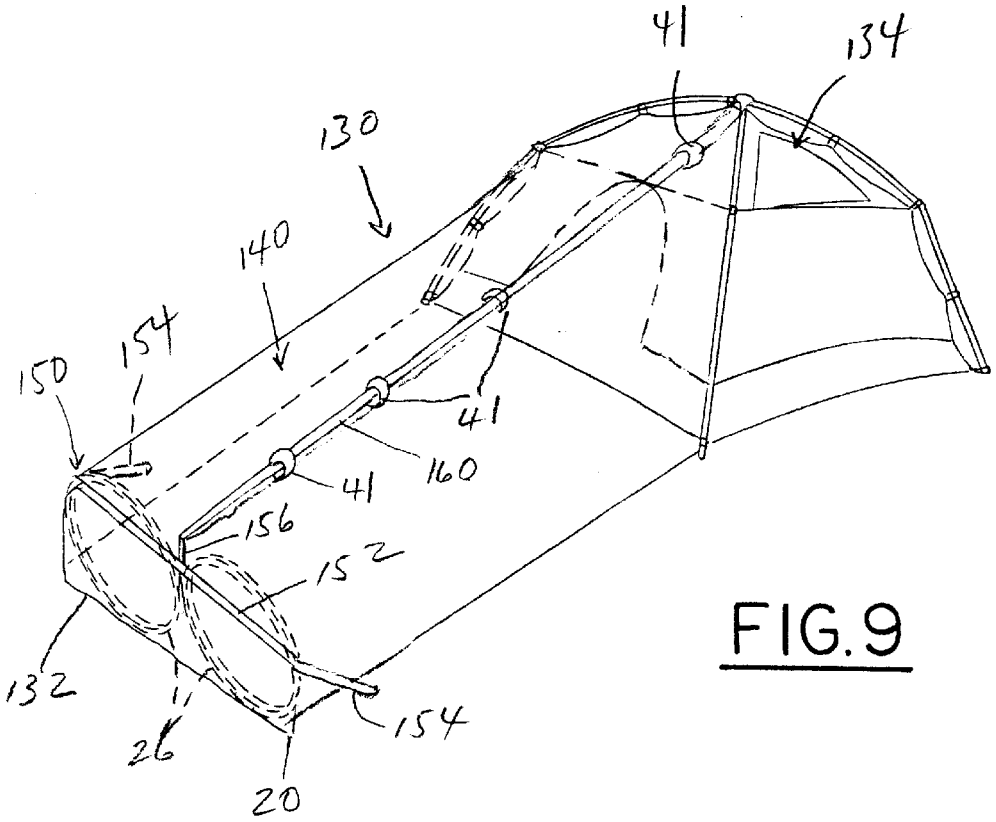

FIG. 9 shows a modified construction in which the tent 130 has only a single end panel 132 and may be used in conjunction with a vehicle (not shown) or a portable shelter 134 of known construction. The tent 130 serves as an extension of the shelter 134 and includes in addition to the end panel 132 a fabric cover 140 which extends from the end panel to the shelter 134. The end panel 132 in FIG. 9 is like the end panel 12 in FIGS. 1–3, having the hoops 26 in the sheet 20 of the end panel. The cover 140 for the tent 130 extends from the end panel 132 and is suitably and releasably secured to the shelter 134. An end frame 150 for the end panel 132 in FIG. 9 comprises a simple horizontal, segmented cross frame member 152 which is releasably secured by any suitable means to the sheet 20 of the end panel. Each end frame 150 has segmented frame members 154 extending along the outer sides of the tent and downwardly at an acute angle from opposite ends of the cross frame member 152. The lower ends of the frame members 154 are anchored in the ground or to the fabric cover. A connector frame member 156 extends upwardly from the cross frame member 152 and a segmented horizontal ridgepole 160 extends from and is releasably secured to the upper end of the connector frame member 156 and to a suitable anchorage on the shelter 134. Connector frame member 156 can be eliminated by bending or otherwise adapting ridgepole 160 to releasably connect to cross frame member 152 or, by means of clips or the like, to be releasably secured to end panel fabric 20 or to hoop(s) 26 or anchored to the ground (not shown). Clips 41 releasably connect the cover 140 to the ridgepole. The segmented ridgepole could be replaced by a flexible cord, if desired.

Figure 10:
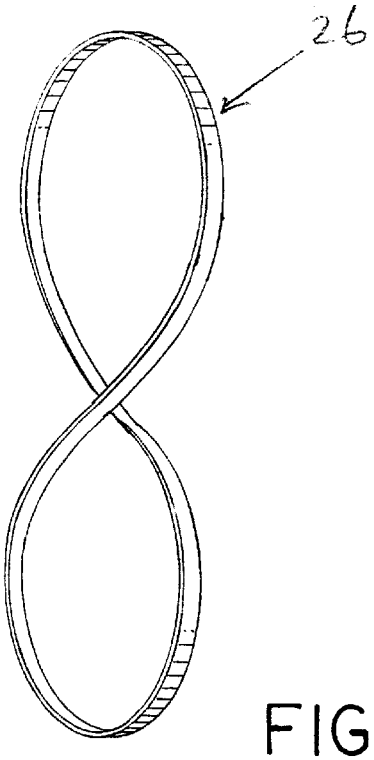
FIG. 10 is an elevational view of a hoop in a partially twisted condition.
Figure 11:
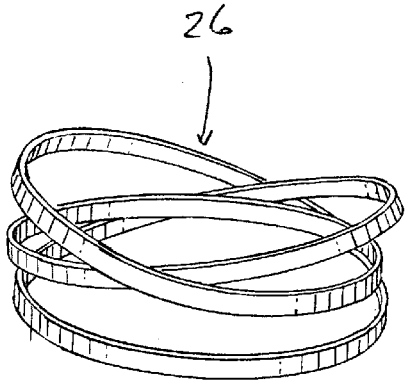
FIG. 11 is a perspective view of the hoop fully twisted.

All of the tents disclosed herein may be collapsed either by removing the frame members of the end frames from their connections to the tent or their anchorage in the ground or by releasing the guy-lines from their anchorage in the ground, and then folding the parts of the fabric cover and end panels together. The various frame member segments may be separated. The end panels can be released from the connecting fabric. Each end panel of the collapsed tent may be twisted into a flat coil of reduced diameter for storage. FIGS. 10 and 11 show one of the hoops 26 of an end panel to illustrate how it may be twisted once (FIG. 10) and then again (FIG. 11) to about one-third its normal size. The hoop 26 might be further twisted to one-ninth its normal size. Because the hoops of the end panels may thus be twisted to a much smaller size, the entire structure is capable of being collapsed to a fraction of its dimensions when erect for convenient transportation and storage. The hoops may be removed from the end panel fabric. The hoops may be continuous, as shown, or not, as desired. They may be circular when the tent is erected, or non-circular, as desired. The hoops in each end panel may be of the same diameter or differing diameters.

What is claimed is:

1. A portable structure for use as a tent or similar structure, said structure having an end panel, said end panel comprising a sheet of substantially non-stretchable flexible fabric material disposed in a generally upright orientation, said sheet having attached thereto at least two hoops of flexible, resilient strip material placed approximately side-by-side, and each defining an interior space, holding means to maintain said end panel in said generally upright orientation, said sheet having a portion in the spaces within said hoops and secured thereto to maintain the same taut and to resist collapse or distortion of said hoops, and means including a flexible fabric cover extending from said end panel and cooperating with said end panel to provide shelter for a person or persons occupying said structure, at least one of said hoops being capable of being twisted into a flat coil of reduced diameter for storage.

2. Structure as defined in claim 1, wherein said holding means includes an elongated substantially rigid member.

3. Structure as defined in claim 1, wherein said holding means includes at least one flexible guy-line.

4. Structure as defined in claim 1, wherein said holding means includes an elongated rigid member in the form of a ridgepole extending from said end panel and serving as a support for the fabric cover.

5. Structure as defined in claim 1, wherein said holding means comprises a substantially rigid end frame supporting said end panel.

6. Structure as defined in claim 5, wherein said rigid end frame includes side frame bars extending along opposite sides of said structure having ends adapted to be anchored in the ground, and a transverse frame bar extending across said end panel and terminally connected to said side frame bars.

7. Structure as defined in claim 6, further including a ridgepole extending between the end panels.

8. Structure as defined in claim 5, wherein said rigid end frame includes side frame bars extending along opposite sides of said structure having ends adapted to be anchored to said fabric cover, and a transverse frame bar extending across said end panel and terminally connected to said side frame bars.

9. Structure as defined in claim 8, further including a ridgepole extending between the end panels.

10. Structure as defined in claim 1, further including a generally rigid center arch of inverted U-shape having generally upright side frame bars connected by an upper transverse frame bar, said center arch supporting said cover.

11. An elongated portable structure for use as a tent or similar structure, said structure having first and second end panels, each of said end panels comprising a sheet of substantially non-stretchable flexible fabric material disposed in a generally upright orientation, each of said sheets having attached thereto at least two hoops of flexible, resilient, strip material placed approximately side-by-side and each defining an interior space, the sheet of each of said end panels having portions thereof in the spaces within the hoops attached thereto and secured to said hoops to maintain the same taut and to resist collapse or distortion of said hoops, holding means for maintaining said end panels in said generally upright orientation and in generally longitudinally spaced relation to one another, and a flexible fabric cover extending between and cooperating with said end panels to provide shelter for a person or persons occupying the structure, at least one of said hoops being capable of being twisted into flat coils of reduced diameter for storage.

12. Structure as defined in claim 11, further including a linear member extending between said end panels and supporting said cover.

13. Structure as defined in claim 12, wherein said linear member is in the form of a substantially rigid ridgepole.

14. Structure as defined in claim 12, wherein said linear member is in the form of a flexible cord.

15. Structure as defined in claim 11, further including a generally rigid center arch of inverted U-shape having generally upright side frame bars connected by an upper transverse frame bar, said center arch supporting said cover.

16. Structure as defined in claim 11, wherein said holding means includes at least one flexible guy-line extending from at least one of said end panels to an anchorage in the ground.

17. Structure as defined in claim 16, further including a rigid transverse frame bar secured to each of said end panels and to which said guy-line is connected.

18. Structure as defined in claim 17, further including a ridgepole extending from one of said end panels to the other and supporting said cover.

19. Structure as defined in claim 17, further including a flexible cord extending from one of said end panels to the other and supporting said cover.

20. Structure as defined in claim 11, wherein said holding means includes rigid end frames secured to and supporting the respective end panels, each of said end frames being of inverted U-shape having legs anchored in the ground, and a transverse frame bar terminally connected to the legs of each of said end frames and extending across the associated one of said end panels.

21. Structure as defined in claim 20, further including a ridgepole extending between said end panels.

22. Structure as defined in claim 11, wherein said holding means includes rigid end frames secured to and supporting the respective end panels, each of said end frames being of inverted U-shape having legs anchored to the fabric cover, and a transverse frame bar terminally connected to the legs of each of said end frames and extending across the associated one of said end panels.

23. Structure as defined in claim 22, further including a ridgepole extending between said end panels.

24. Structure as defined in claim 11, wherein each of said end panels has one or more additional hoops of flexible, resilient material.

25. Structure as defined in claim 24 further including a rigid center arch of inverted U-shape having generally upright side frame bars connected by an upper transverse frame bar, said center arch supporting said cover.

* * * * *